US011493236B2

(12) United States Patent
Shichi et al.

(10) Patent No.: US 11,493,236 B2
(45) Date of Patent: Nov. 8, 2022

(54) GAS MANIFOLD

(71) Applicant: Rinnai Corporation, Aichi (JP)

(72) Inventors: Kazuyuki Shichi, Aichi (JP); Kunio Kataoka, Aichi (JP)

(73) Assignee: Rinnai Corporation, Aichi (JP)

( * ) Notice: Subject to any disclaimer, the term of this patent is extended or adjusted under 35 U.S.C. 154(b) by 0 days.

(21) Appl. No.: 17/149,296

(22) Filed: Jan. 14, 2021

(65) Prior Publication Data

US 2021/0293453 A1 Sep. 23, 2021

(30) Foreign Application Priority Data

Mar. 17, 2020 (JP) ..... JP2020-045972

(51) Int. Cl.

| | |
|---|---|
| ***F24H 9/02*** | (2006.01) |
| ***F24H 9/20*** | (2022.01) |
| ***F24H 1/12*** | (2022.01) |
| ***F24H 1/14*** | (2022.01) |
| ***F24H 9/13*** | (2022.01) |

(52) U.S. Cl.

CPC ..... *F24H 9/2035* (2013.01); *F24H 1/124* (2013.01); *F24H 1/145* (2013.01); *F24H 9/02* (2013.01); *F24H 9/139* (2022.01); *F23N 2239/06* (2020.01); *F23N 2241/04* (2020.01); *F23N 2900/00* (2013.01)

(58) Field of Classification Search

CPC ..... F24H 9/2035; F24H 1/124; F24H 1/145; F24H 9/02; F23N 2900/00; F23N 2239/06; F23N 2241/04; F23N 2900/01002

See application file for complete search history.

(56) References Cited

U.S. PATENT DOCUMENTS

| | | | | |
|---|---|---|---|---|
| 6,179,212 | B1 * | 1/2001 | Banko | F23N 1/005 236/1 E |
| 8,206,147 | B2 * | 6/2012 | Videto | F23N 1/002 431/255 |
| 9,291,364 | B2 * | 3/2016 | Okamoto | F23N 1/002 |

FOREIGN PATENT DOCUMENTS

| | | | |
|---|---|---|---|
| JP | H8-086416 | A | 4/1996 |
| JP | 2010096363 | * | 4/2010 |
| JP | 2018025324 | * | 2/2018 |
| JP | 2019-002594 | A | 1/2019 |
| KR | 2020023832 | * | 3/2020 |

* cited by examiner

*Primary Examiner* — Gregory A Wilson

(74) *Attorney, Agent, or Firm* — Nakanishi IP Associates, LLC

(57) ABSTRACT

A gas manifold allows each distribution chamber to be fed with fuel gas at an appropriate flow rate irrespective of an increase in the number of distribution chambers included in the gas manifold. A gas manifold distributes fuel gas flowing in through an inlet to a plurality of distribution chambers through a main channel. The main channel includes a flow guide that guides the fuel gas toward a maximum distribution chamber and reduces the fuel gas flowing into other distribution chambers. This allows fuel gas at a sufficient flow rate to be fed more easily to the maximum distribution chamber than to the other distribution chambers for a larger number of distribution chambers included in the gas manifold, allowing the plurality of distribution chambers to be fed with fuel gas at appropriate flow rates.

6 Claims, 6 Drawing Sheets

| Distribution chamber | Number of burners fed with fuel gas |
|---|---|
| Distribution chamber 102a (Maximum distribution chamber) | 8 |
| Distribution chamber 102b (Minimum distribution chamber) | 2 |
| Distribution chamber 102c | 3 |
| Distribution chamber 102d | 6 |

GAS MANIFOLD

BACKGROUND OF INVENTION

Field of the Invention

The present invention relates to a gas manifold for distributing fuel gas to a plurality of burners in a combustion apparatus that performs stepwise switching of the number of burners to burn the fuel gas among the plurality of burners included in the combustion apparatus.

Background Art

Hot-water supply systems and heating systems incorporate a combustion apparatus for burning fuel gas. The combustion apparatus includes a plurality of burners that are individually fed with fuel gas through their corresponding nozzles. The combustion apparatus also performs stepwise switching of the number of burners to burn the fuel gas. In accordance with intended thermal power, the apparatus increases or decreases the number of burners to be used for burning the fuel gas.

Each burner is fed with fuel gas through the corresponding nozzle. Thus, stepwise switching of the number of burners to burn the fuel gas involves stepwise switching of the number of nozzles to feed the fuel gas. A multi-burner combustion apparatus includes a gas manifold for distributing fuel gas to each burner, and the manifold has the structure below. The gas manifold has an internal main channel allowing passage of fuel gas fed from outside. The main channel branches into a plurality of distribution channels that are connected to distribution chambers via electromagnetic on-off valves. The nozzles for feeding the burners with fuel gas each receive the fuel gas from one of the distribution chambers.

In the gas manifold with the above structure, when the main channel is fed with fuel gas, the fuel gas flows into the distribution chamber connected to a distribution channel with its electromagnetic on-off valve open. The fuel gas is then fed through the nozzles to the burners. In contrast, the fuel gas does not flow into the distribution chamber connected to a distribution channel with its electromagnetic on-off valve closed. The nozzles that receive fuel gas from the distribution chamber are fed with no fuel gas, and thus the burners are also fed with no fuel gas. In this structure, the number of burners to burn fuel gas may be switched in a stepwise manner by switching the open or closed states of the electromagnetic on-off valves in the switch distribution channels.

The number of burners fed with fuel gas from each distribution chamber is set differently for each distribution chamber. This is because switching the distribution chambers for feeding fuel gas to burners causes switching the number of burners to burn the fuel gas, thus causing the thermal power to be changed to multiple levels. An example with nine burners and three distribution chambers will be described. With each distribution chamber including three burners assigned, the burners for burning fuel gas may be switched between three, six, and nine burners, which are three sets of burners, by changing the number of distribution chambers that feed the fuel gas. However, the nine burners may also be divided into two, three, and four burners. These burner sets may be assigned to the distribution chambers. In this case, the number of burners may be changed to switch between seven thermal power levels depending on the selection of a distribution chamber or the combination of distribution chambers.

With each distribution chamber including a different number of burners assigned in this manner, the flow rate of the fuel gas to be fed to each distribution chamber also depends on the distribution chamber. In the above example, the distribution chamber with four burners is to be fed with fuel gas at a flow rate twice as much as for the distribution chamber with two burners. Thus, techniques for feeding fuel gas at an appropriate flow rate to each distribution chamber have been developed using the electromagnetic on-off valves with different sizes in the distribution channels or installing different-sized orifices in the distribution channels depending on the flow rate of the fuel gas to be fed to each distribution chamber (Patent Literatures 1 and 2).

CITATION LIST

Patent Literature

Patent Literature 1: Japanese Unexamined Patent Application Publication No. 8-086416

Patent Literature 2: Japanese Unexamined Patent Application Publication No. 2019-002594

SUMMARY OF INVENTION

However, recent combustion apparatuses may perform switching between more sets of burners to regulate the thermal power more precisely. In this case, feeding each distribution chamber with fuel gas at an appropriate flow rate has become more difficult for the reasons described below. More sets of switchable burners mean more distribution chambers included in the gas manifold. The number of burners fed with fuel gas from each distribution chamber is set differently for each distribution chamber as described above. The increasing number of distribution chambers widens the difference in the number of burners between the distribution chamber including the smallest number of burners and the distribution chamber including the largest number of burners, and increases the difference between the flow rates of fuel gas to be fed. A largely increasing flow rate difference may cause difficulty in feeding each distribution chamber with fuel gas at an appropriate flow rate.

In response to the above issue with the known techniques, one or more aspects of the present invention are directed to a gas manifold that allows each distribution chamber to be fed with fuel gas at an appropriate flow rate irrespective of an increase in the number of internal distribution chambers.

A gas manifold according to one aspect of the present invention has the structure below. The gas manifold is installable in a combustion apparatus to distribute fuel gas to a plurality of burners for burning the fuel gas included in the combustion apparatus. The plurality of burners are grouped into a plurality of burner sets. The combustion apparatus performs stepwise switching of the number of burners to burn the fuel gas by causing each of the plurality of burner sets to burn the fuel gas. The gas manifold includes a main channel that allows passage of the fuel gas fed from outside, a plurality of distribution chambers, each located for a corresponding burner set of the plurality of burner sets, that receive, from the main channel, the fuel gas to be fed to the plurality of burners in the plurality of burner sets, a plurality of nozzles, each located for a corresponding burner of the plurality of burners, that feed the plurality of burners with the fuel gas flowing into the plurality of distribution chambers, a plurality of distribution channels branching from the main channel and connecting the main channel to the plurality of distribution chambers, and a plurality of on-off valves located at the plurality of distribution channels to open or close the plurality of distribution channels (i.e., a plurality of on-off valves each located at a corresponding distribution channel of the plurality of distribution channels to open or close the corresponding distribution channel). The plurality of distribution chambers include a maximum distribution chamber and distribution chambers other than the maximum distribution chamber. The maximum distribution chamber includes more burners in the corresponding burner set than each of the other distribution chambers. The main channel includes a flow guide that guides the fuel gas toward a maximum distribution channel being a distribution channel included in the plurality of distribution channels connected to the maximum distribution chamber. The flow guide narrows the main channel to reduce the fuel gas flowing into distribution channels other than the maximum distribution channel included in the plurality of distribution channels.

In the gas manifold according to the aspect, the fuel gas fed to the main channel flows into the distribution chambers through the distribution channels branching from the main channel. The fuel gas is then fed from each distribution chamber to the burners through the nozzles. The main channel includes the flow guide that guides the fuel gas toward the maximum distribution channel, which is the distribution channel of the maximum distribution chamber (the distribution chamber including the largest number of burners to be fed with fuel gas). The flow guide narrows the main channel to reduce the fuel gas flowing into the distribution channels of the other distribution chambers.

The flow guide allows the maximum distribution chamber to be fed with fuel gas more easily than the other distribution chambers. This allows fuel gas at a sufficient flow rate to be fed to the maximum distribution chamber for a larger number of distribution chambers included in the gas manifold. More specifically, the plurality of distribution chambers are fed with fuel gas at appropriate flow rates.

In the gas manifold according to the above aspect, the main channel may include a part narrowed by the flow guide, and the narrowed part may have a channel area larger than a total opening area of the distribution channels other than the maximum distribution channel at branches of the other distribution channels from the main channel.

In this aspect, the flow guide located in the main channel allows an enough fuel gas flow through the part of the main channel narrowed by the flow. This can avoid a shortage of fuel gas fed to the distribution chambers other than the maximum distribution chamber.

In the gas manifold according to the above aspect, a branch of the maximum distribution channel from the main channel may be at an outer side (end position) of other branches of the other distribution channels from the main channel. The fuel gas may flow into the main channel through an inlet located between the branch of the maximum distribution channel from the main channel and a branch of a distribution channel next to the maximum distribution channel from the main channel.

In this aspect, the fuel gas flowing into the main channel through the inlet is guided to the maximum distribution channel by the flow guide. This situation means the fuel gas is guided in a direction opposite to the other distribution channels. Thus, with a flow guide narrowing the main channel slightly, the maximum distribution channel may be fed with the fuel gas at a sufficient flow rate. Additionally, the part narrowed by the flow guide can have a lower passage resistance to fuel gas, allowing the distribution channels other than the maximum distribution channel to be fed with fuel gas at sufficient flow rates.

As described above, in the gas manifold according to the above aspect, the flow guide is located between the branch of the maximum distribution channel from the main channel and one of the branches of the other distribution channels from the main channel. With this structure, the distribution channel (hereafter, minimum distribution channel) connected to a minimum distribution chamber (the chamber including fewer burners to be fed with fuel gas than the other distribution chambers) may branch from the main channel at a most upstream position of a plurality of distribution channels branching from the main channel downstream from the flow guide.

The main channel downstream from the flow guide has a pressure gradient caused by a fuel gas flow, with an upstream portion of the fuel gas having a higher pressure. The minimum distribution channel has the highest channel resistance of the plurality of distribution channels. Thus, with the minimum distribution channel branching from the main channel at the most upstream position of the distribution channels branching from the main channel downstream from the flow guide, the minimum distribution channel may also be fed with fuel gas at a sufficient flow rate.

In the gas manifold according to the above aspect, the main channel, the plurality of distribution chambers, and the inlet receiving fuel gas may be located as described below. A manifold body may include a channel groove, and a plurality of recesses adjacent to the channel groove. A manifold cover may be fitted to the manifold body to be placed over the channel groove to define the main channel, and over the plurality of recesses to define the plurality of distribution chambers. The inlet may be open from the manifold body to the manifold cover. The plurality of distribution channels connecting the main channel and the distribution chambers may be open in the channel groove nearer a bottom of the channel groove than the manifold cover.

In this aspect, after flowing in through the inlet, hitting the manifold cover, and changing direction, the fuel gas flows along the manifold cover (or away from the bottom of the channel groove). Thus, with the distribution channels open in the channel groove nearer the bottom of the channel groove than the manifold cover, the fuel gas flowing in the main channel does not directly flow into any distribution channel. This prevents the fuel gas from flowing intensively into some of the distribution channels, thus allowing fuel gas at appropriate flow rates to be fed to the distribution chambers.

In the gas manifold according to the above aspect, the manifold cover and the manifold body may hold a sealing member formed from a compressible material when the manifold cover is fitted to the manifold body. The flow guide may protrude from the bottom of the channel groove as a wall, and the flow guide may protrude by a height smaller than a depth of the channel groove and be in contact with the sealing member located between the manifold cover and the manifold body.

In this aspect, when the manifold cover is fitted to the manifold body with the sealing member between them, the reaction force exerted by the flow guide on the sealing member and the manifold cover is sufficiently small. The structure including the flow guide can avoid a decrease in the contact stress between the sealing member and the main channel and thus avoid leakage of the fuel gas flowing through the main channel. Further, the flow guide, which is in contact with the sealing member, prevents the fuel gas from flowing between the flow guide and the sealing member, and thus reliably guides the fuel gas flowing in through the inlet to the maximum distribution channel.

DETAILED DESCRIPTION

Figure 1:
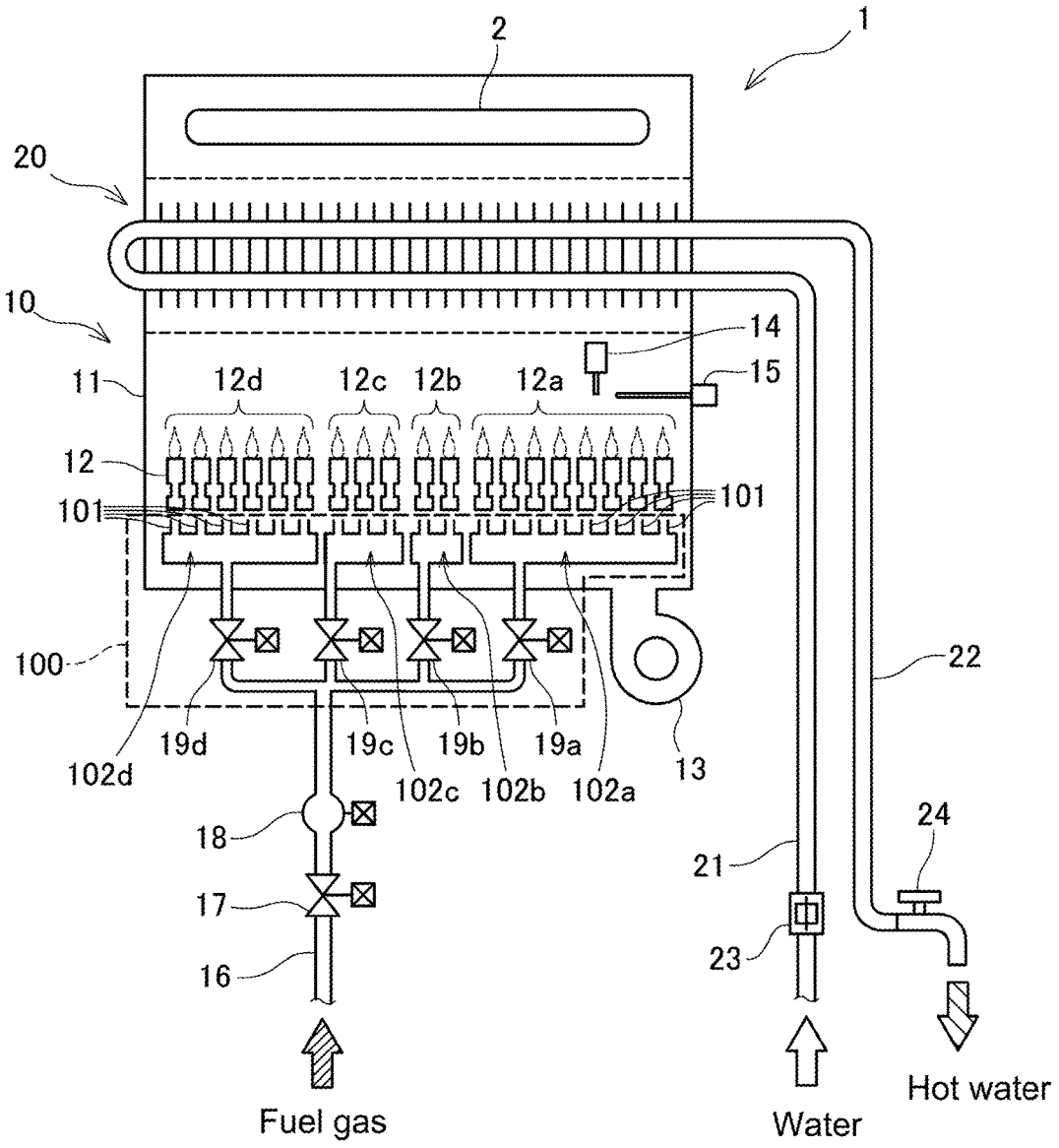
FIG. 1 is a diagram of a water heater 1 including a combustion apparatus 10.

FIG. 1 is a diagram of a water heater 1 including a combustion apparatus 10. The water heater 1 includes the combustion apparatus 10 that burns fuel gas, and a heat exchanger 20 that uses hot combustion gas generated in the combustion apparatus 10 to produce hot water. The heat exchanger 20 is connected to a water supply channel 21 that receives service water, and a hot-water supply channel 22 that feeds the hot water produced in the heat exchanger 20. The water supply channel 21 has, on its course, a flow sensor 23 that detects the flow rate of service water flowing into the heat exchanger 20. In addition, the hot-water supply channel 22 has a hot-water supply faucet 24 connected to its end.

The combustion apparatus 10 includes a combustion case 11 that defines a combustion chamber in its inner space, a plurality of burners 12 installed in the combustion case 11, a gas manifold 100 that feeds the burners 12 with fuel gas, a combustion fan 13 that feeds the combustion case 11 with combustion air for burning the fuel gas, a spark plug 14 that lights the burners 12, and a flame rod 15 that detects the flame of the burners 12. The gas manifold 100 is connected to a gas channel 16 that feeds the fuel gas, and the gas channel 16 includes, on its course, a main valve 17 that opens or closes the gas channel 16, and a proportional valve 18 that regulates the flow rate of the fuel gas downstream from the main valve 17.

As shown in FIG. 1, the combustion apparatus 10 according to the present embodiment includes 19 burners 12. The burners 12 are grouped into four burner sets 12*a* to 12*d* each including a different number of burners 12. In the illustrated example, the burner set 12*a* includes eight adjacent burners 12, the burner set 12*b* includes two adjacent burners 12, the burner set 12*c* includes three adjacent burners 12, and the burner set 12*d* includes six adjacent burners 12.

The gas manifold 100 includes a plurality of nozzles 101 that feed the burners 12 with fuel gas. Each nozzle 101 is associated with one burner 12 in advance and feeds the burner 12 with the fuel gas. The gas manifold 100 also includes four internal distribution chambers 102*a* to 102*d*. The four distribution chambers 102*a* to 102*d* correspond to the four burner sets 12*a* to 12*d* described above. An electromagnetic on-off valve 19*a* is installed upstream from the distribution chamber 102*a*, an electromagnetic on-off valve 19*b* upstream from the distribution chamber 102*b*, an electromagnetic on-off valve 19*c* upstream from the distribution chamber 102*c*, and an electromagnetic on-off valve 19*d* upstream from the distribution chamber 102*d*. The electromagnetic on-off valves 19*a* to 19*d* may be open or closed to feed the distribution chambers 102*a* to 102*d* individually with the fuel gas. The electromagnetic on-off valves 19*a* to 19*d* in the present embodiment correspond to on-off valves in the aspects of the present invention.

As described above, each nozzle 101 feeds fuel gas to the specific burner 12 associated with it in advance, and the nozzles 101 that feed fuel gas to the burners 12. The nozzles 101 that feed fuel gas to the burners 12 in the burner set 12*a* receive the fuel gas from the distribution chamber 102*a*. Likewise, the nozzles 101 that feed fuel gas to the burners 12 in the burner set 12*b* receive the fuel gas from the distribution chamber 102*b*, the nozzles 101 that feed fuel gas to the burners 12 in the burner set 12*c* receive the fuel gas from the distribution chamber 102*c*, and the nozzles 101 that feed fuel gas to the burners 12 in the burner set 12*d* receive the fuel gas from the distribution chamber 102*d*. The electromagnetic on-off valves 19*a* to 19*d* may be open or closed to cause each of the burner sets 12*a* to 12*d* to individually start or stop feeding fuel gas to the burners 12. Each of the burner sets 12*a* to 12*d* may thus individually start or end the combustion of the fuel gas by the burners 12.

In the above water heater 1, when a user of the water heater 1 opens the hot-water supply faucet 24 on the hot-water supply channel 22, the heat exchanger 20 is fed with service water through the water supply channel 21. When the flow sensor 23 detects the flow rate of the service water reaching at least a predetermined flow rate, burners 12 start combustion. In accordance with intended thermal power, the degree of opening of the proportional valve 18 is controlled, and the electromagnetic on-off valves 19*a* to 19*d* are open or closed. This allows multi-level switching of the number of burners 12 to burn the fuel gas. The hot combustion gas generated in the combustion passes through the heat exchanger 20 above the combustion apparatus 10. During the passage, the hot combustion gas exchanges heat with the service water passing through the heat exchanger 20 to generate hot water, which flows through the hot-water supply channel 22 and out of the hot-water supply faucet 24. The combustion gas with the temperature lowered by the heat exchange is discharged from the water heater 1 through an outlet 2 above the heat exchanger 20.

Figure 2:
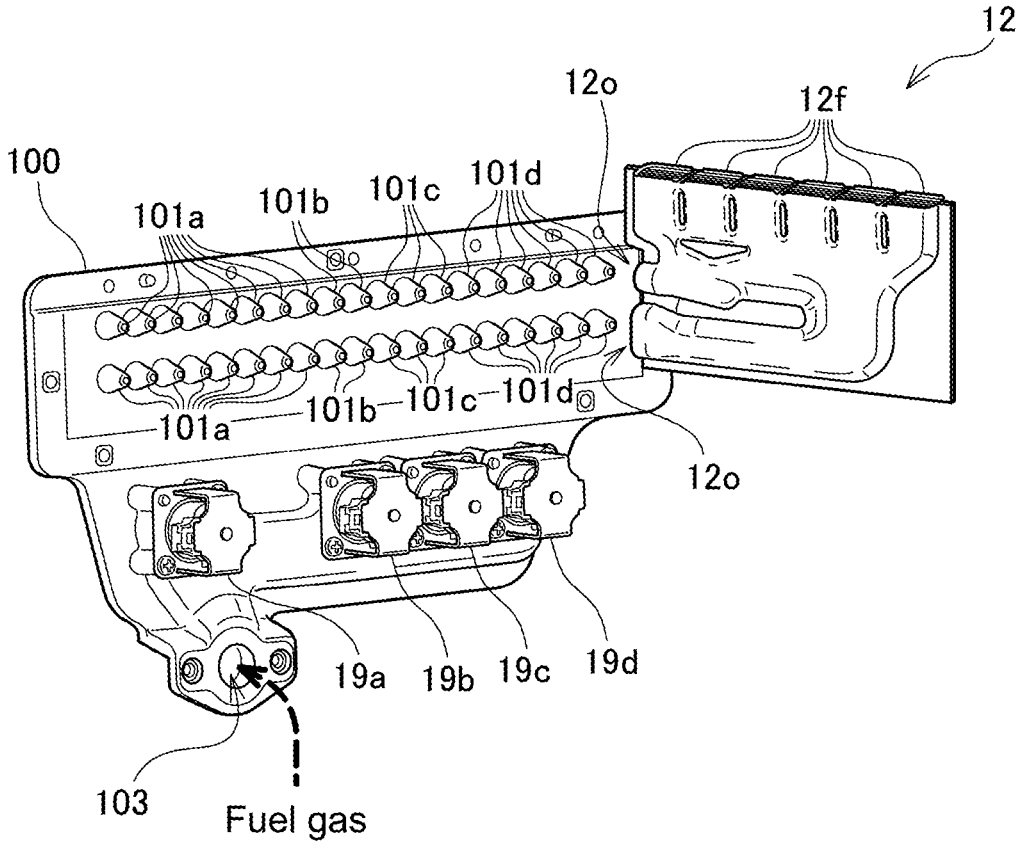
FIG. 2 is a view of a gas manifold 100 and a burner 12 according to an embodiment showing their structures.

FIG. 2 is a view of the gas manifold 100 and a burner 12 according to the present embodiment showing the positional relationship between them. As described above, the water heater 1 according to the present embodiment includes the 19 burners 12. To simplify the drawing, FIG. 2 shows one burner 12 without the 18 other burners 12.

The burner 12 includes combined metal plates and has two gas inlets 12*o* (upper gas inlets 12*o* and lower gas inlets 12*o*) in its side surface to receive fuel gas. When injected into each gas inlet 12*o*, fuel gas flows into the burner 12 through the gas inlets 12*o* together with the surrounding air. The fuel gas and air mix in the burner 12 into mixed gas, and then the mixed gas flows out through a plurality of burner ports 12*f* formed in the top surface of the burner 12. The mixed gas is ignited with the spark plug 14 (refer to FIG. 1) to start combustion by the burner 12.

In correspondence with the two gas inlets 12*o* (upper and lower gas inlets) in the burner 12 according to the present embodiment, the nozzles 101 in the gas manifold 100 according to the present embodiment are arranged in two lines (upper and lower lines). A pair of upper and lower nozzles 101 injects fuel gas into the upper and lower gas inlets 12*o* in the burner 12. As described above, the water heater 1 according to the present embodiment includes the 19 burners 12. Each burner 12 is associated with one pair of upper and lower nozzles 101, and thus the gas manifold 100 includes 38 (=19×2) nozzles 101 in total. As described above, the 19 burners 12 are grouped into the four burner sets 12*a* to 12*d*, and thus the 38 nozzles 101 for feeding fuel gas to the burners 12 can be grouped into a nozzle set 101*a* for feeding fuel gas to the burners 12 in the burner set 12*a*, a nozzle set 101*b* for feeding fuel gas to the burners 12 in the burner set 12*b*, a nozzle set 101*c* for feeding fuel gas to the burners 12 in the burner set 12*c*, and a nozzle set 101*d* for feeding fuel gas to the burners 12 in the burner set 12*d*.

As shown in FIG. 2, the four electromagnetic on-off valves 19*a* to 19*d* are attached below the nozzles 101. Under the electromagnetic on-off valves 19*a* to 19*d*, an inlet 103 is located to receive fuel gas. When the electromagnetic on-off valve 19*a* is open with the inlet 103 receiving fuel gas, the fuel gas is fed through the gas manifold 100 and the nozzles 101 in the nozzle set 101*a* to the burners 12 in the burner set 12*a*. The internal structure of the gas manifold 100 will be described later. When the electromagnetic on-off valve 19*b* is open, the fuel gas is fed through the nozzles 101 in the nozzle set 101*b* to the burners 12 in the burner set 12*b*. Likewise, when the electromagnetic on-off valve 19*c* is open, the fuel gas is fed through the nozzles 101 in the nozzle set 101*c* to the burners 12 in the burner set 12*c*. When the electromagnetic on-off valve 19*d* is open, the fuel gas is fed through the nozzles 101 in the nozzle set 101*d* to the burners 12 in the burner set 12*d*.

Figure 3:
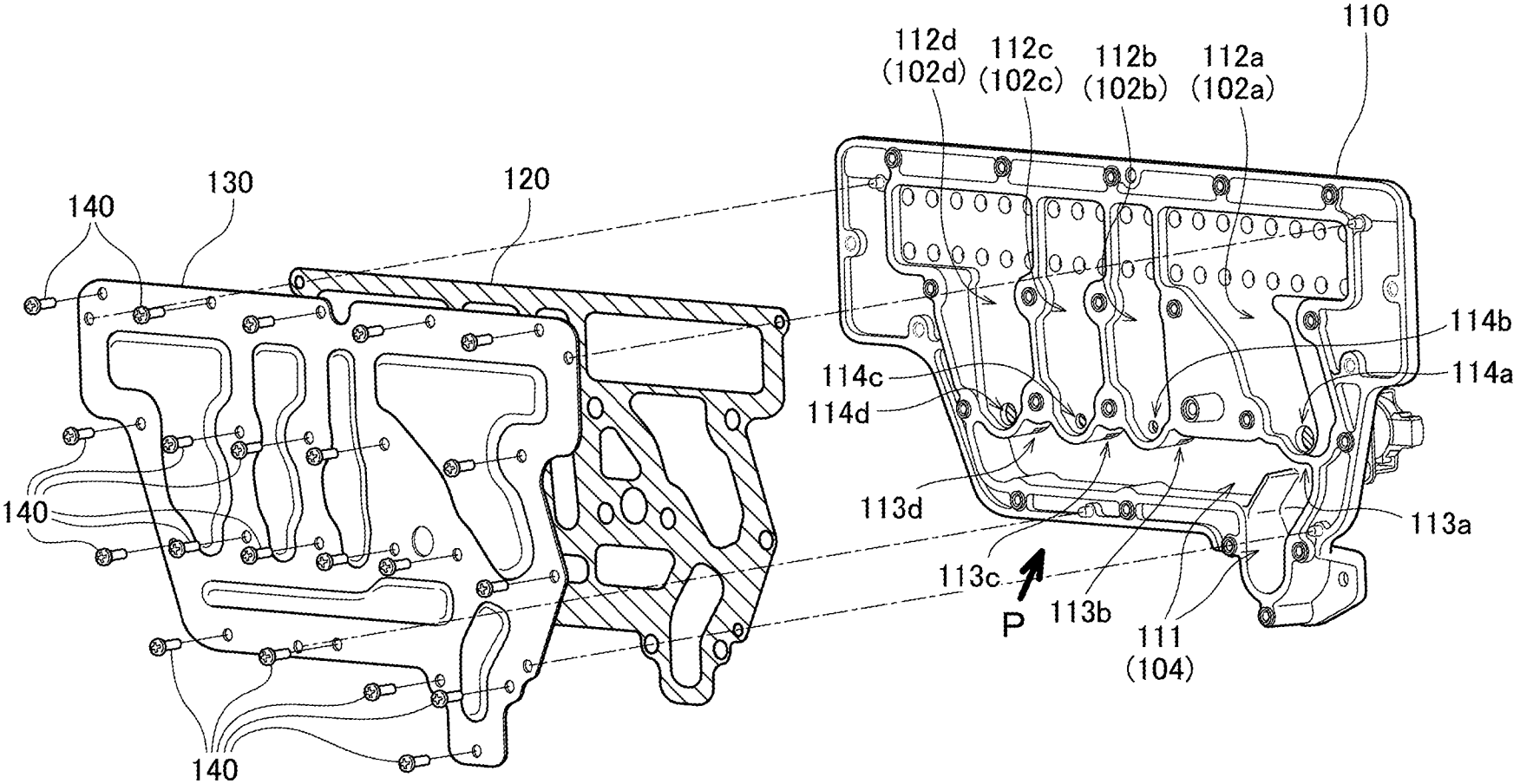
FIG. 3 is an exploded view of the gas manifold 100 according to the embodiment.

FIG. 3 is an exploded view of the gas manifold 100 according to the present embodiment. As shown in the figure, the gas manifold 100 includes a die-cast or cast manifold body 110, a sealing member 120 formed from a compressible material such as rubber, and a sheet-metal manifold cover 130 attached to the manifold body 110 with multiple mounting screws 140 with the sealing member 120 between the manifold body 110 and the manifold cover 130. The manifold cover 130, which is formed from sheet-metal in the present embodiment, may be die-cast or cast.

As shown in the figure, the manifold body 110 has four recesses 112*a* to 112*d* located in line and a channel groove 111 immediately below the recesses 112*a* to 112*d*. When the manifold cover 130 is fitted to the manifold body 110 with the sealing member 120 between them, the recess 112*a* is covered with the manifold cover 130 to define the distribution chamber 102*a* (refer to FIG. 1). The recess 112*b* defines the distribution chamber 102*b* (refer to FIG. 1), the recess 112*c* defines the distribution chamber 102*c* (refer to FIG. 1), and the recess 112*d* defines the distribution chamber 102*d* (refer to FIG. 1). In FIG. 3, the numeral in parentheses (102*a*) below the recess 112*a* indicates that the recess 112*a* will form the distribution chamber 102*a* when the manifold cover 130 is attached to it. Likewise, in FIG. 3, the numeral (102*b*) below the recess 112*b* indicates that the recess 112*b* will form the distribution chamber 102*b*, the numeral (102*c*) below the recess 112*c* indicates that the recess 112*c* will form the distribution chamber 102*c*, and the numeral (102*d*) below the recess 112*d* indicates that the recess 112*d* will form the distribution chamber 102*d*. In addition, a main channel 104 is defined by the manifold cover 130 placed over the channel groove 111 on the manifold body 110. In FIG. 3, the numeral (104) below the channel groove 111 indicates that the channel groove 111 will form the main channel 104.

The recess 112*a* also has, in its lower part (adjacent to the channel groove 111), a valve port 114*a* for the electromagnetic on-off valve 19*a* (refer to FIG. 2), and the valve port 114*a* connects to the valve chamber for the electromagnetic on-off valve 19*a*. Likewise, the recess 112*b* has, in its lower part, a valve port 114*b* for the electromagnetic on-off valve 19*b* (refer to FIG. 2), the recess 112*c* has, in its lower part, a valve port 114*c* for the electromagnetic on-off valve 19*c* (refer to FIG. 2), and the recess 112*d* has, in its lower part, a valve port 114*d* for the electromagnetic on-off valve 19*d* (refer to FIG. 2). The valve port 114*b* connects to the valve chamber for the electromagnetic on-off valve 19*b*, the valve port 114*c* connects to the valve chamber for the electromagnetic on-off valve 19*c*, and the valve port 114*d* connects to the valve chamber for the electromagnetic on-off valve 19*d*.

In addition, the valve chambers for the electromagnetic on-off valves 19*a* to 19*d* each have an opening in the side corresponding to the side wall of the channel groove 111. An opening 113*b* in FIG. 3 in the side wall of the channel groove 111 connects to the valve chamber for the electromagnetic on-off valve 19*b*. An opening 113*c* in FIG. 3 in the side wall of the channel groove 111 connects to the valve chamber for the electromagnetic on-off valve 19*c*. An opening 113*d* in FIG. 3 in the side wall of the channel groove 111 connects to the valve chamber for the electromagnetic on-off valve 19*d*. An opening 113*a* in the side wall of the channel groove 111 also connects to the valve chamber for the electromagnetic on-off valve 19*a* although the opening 113*a* is not shown in FIG. 3.

Figure 4:
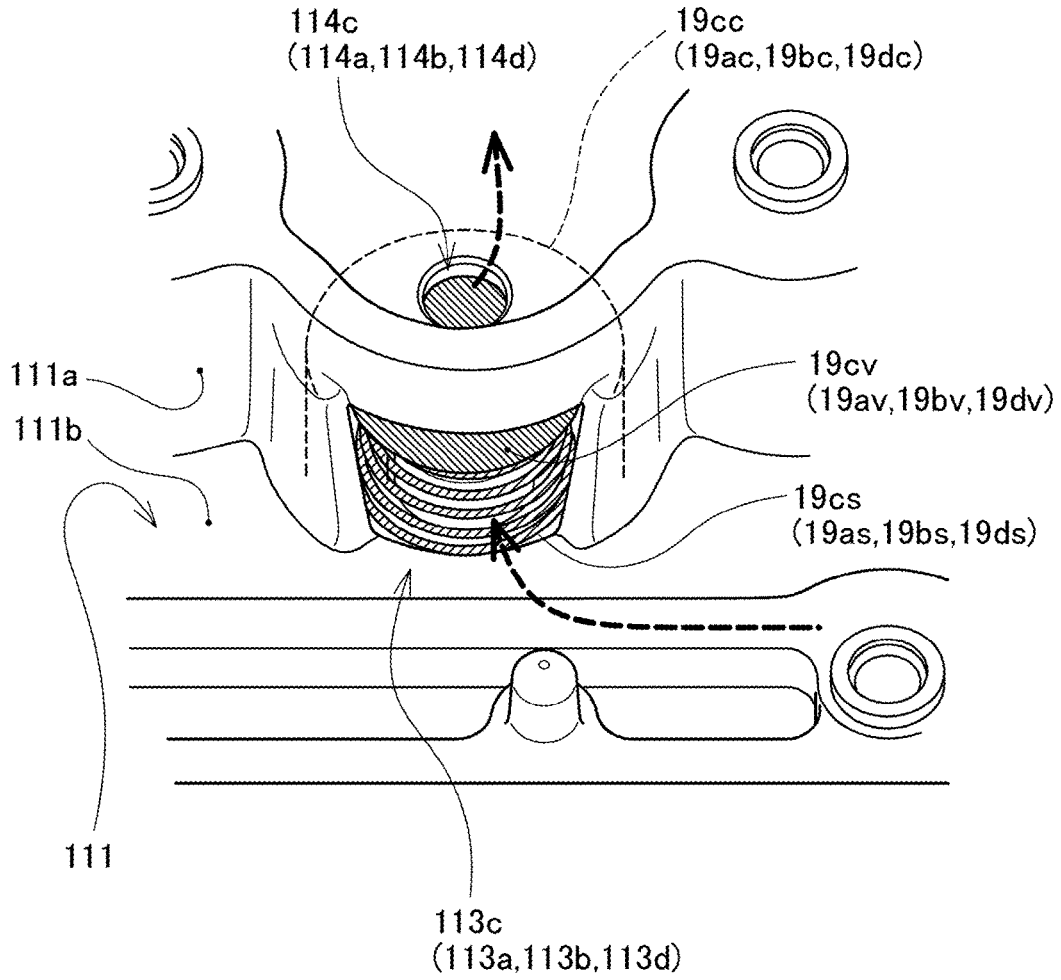
FIG. 4 is a perspective view of a channel groove 111 showing the detailed shape of an opening 113*c* in its side wall.

FIG. 4 is a perspective view of the channel groove 111 showing the detailed shape of the opening 113*c* in its side wall as viewed in the direction indicated by arrow P in FIG. 3. The opening 113*a*, the opening 113*b*, and the opening 113*d* have the same shape as the opening 113*c* and are not shown. In FIG. 4, the numerals in parentheses (113*a*, 113*b*, 113*d*) below the opening 113*c* indicate that the opening 113*c* represents these openings.

As shown in FIG. 4, the channel groove 111 has a side wall 111*a* and a bottom 111*b*, and the opening 113*c* in the side wall 111*a* at a position adjacent to the bottom 111*b*. The opening 113*c* connects to a valve chamber 19*cc* for the electromagnetic on-off valve 19*c* (refer to FIG. 2). The valve chamber 19*cc* accommodates a valve element 19*cv* in the electromagnetic on-off valve 19*c*. The valve element 19*cv* is urged against the valve port 114*c* by a spring 19*cs* for the electromagnetic on-off valve 19*c*. In FIG. 4, the numerals in parentheses (114*a*, 114*b*, 114*d*) below the valve port 114*c* indicate that the valve port 114*c* represents the valve port 114*a*, the valve port 114*b*, and the valve port 114*d*. In FIG. 4, the numerals (19*ac*, 19*bc*, 19*dc*) below the valve chamber 19*cc* indicate that the valve chamber 19*cc* represents a valve chamber 19*ac*, a valve chamber 19*bc*, and a valve chamber 19*dc*, and the numerals (19*av*, 19*bv*, 19*dv*) below the valve element 19*cv* indicate that the valve element 19*cv* represents a valve element 19*av*, a valve element 19*bv*, and a valve element 19*dv*. In addition, the numerals (19*as*, 19*bs*, 19*ds*) below the spring 19*cs* indicate that the spring 19*cs* represents a spring 19*as*, a spring 19*bs*, and a spring 19*ds*.

In this manner, the channel groove 111 connects to the recess 112*a* (refer to FIG. 3) through the opening 113*a*, the valve chamber 19*ac*, and the valve port 114*a*. Thus, the electromagnetic on-off valve 19*a* shown in FIG. 2 is open to define a channel connecting the channel groove 111 and the recess 112*a*. The channel from the channel groove 111 to the recess 112*a* corresponds to a distribution channel in the aspects of the present invention. Likewise, the electromagnetic on-off valve 19*b* is open to define a channel connecting the channel groove 111 and the recess 112*b* (refer to FIG. 3). The electromagnetic on-off valve 19*c* is open to define a channel connecting the channel groove 111 and the recess 112*c* (refer to FIG. 3). The electromagnetic on-off valve 19*d* is open to define a channel connecting the channel groove 111 and the recess 112*d* (refer to FIG. 3). The channel from the channel groove 111 to the recess 112*b*, the channel from the channel groove 111 to the recess 112*c*, and the channel from the channel groove 111 to the recess 112*d* also correspond to distribution channels in the aspects of the present invention.

Figures 5, 6:
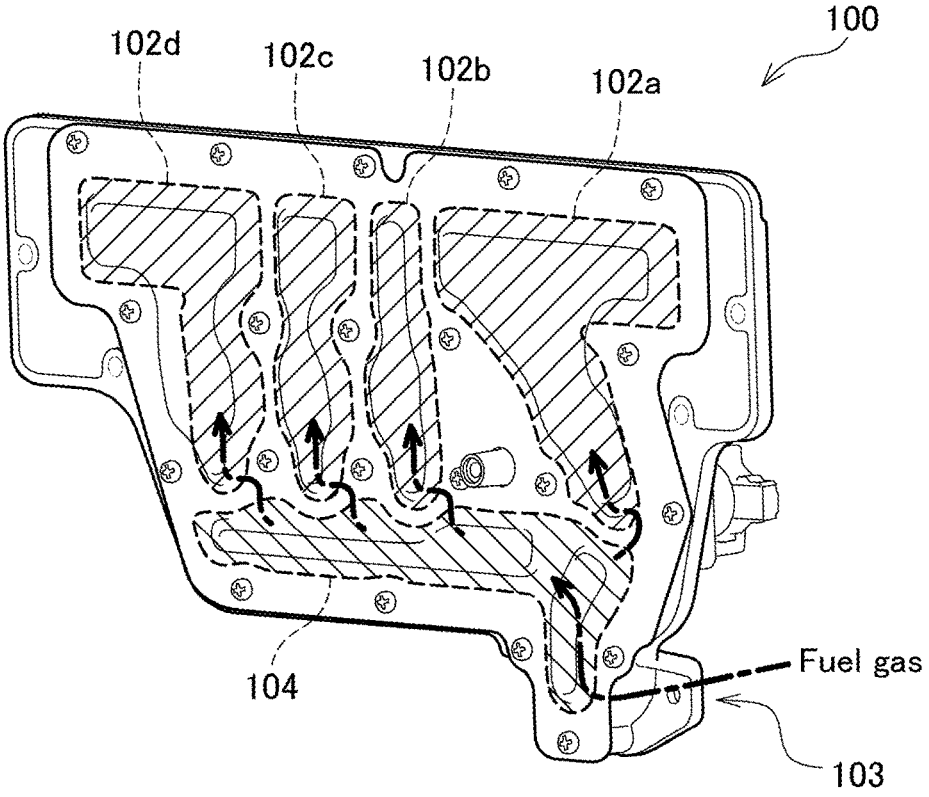
FIG. 5 is a view of the gas manifold 100 according to the embodiment showing fuel gas flows in the manifold.
FIG. 6 is a diagram describing a comparison between the numbers of burners 12 fed with fuel gas from distribution chambers 102*a* to 102*d* in the gas manifold 100 according to the embodiment.

FIG. 5 is a view of the gas manifold 100 according to the present embodiment with the structure described above, showing fuel gas flows in the manifold. The fuel gas fed through the inlet 103 flows first into the main channel 104. As described above with reference to FIG. 3, the main channel 104 is defined between the channel groove 111 on the manifold body 110 and the manifold cover 130. The four distribution chambers 102*a* to 102*d* are located above the main channel 104. As described above with reference to FIG. 3, the four distribution chambers 102*a* to 102*d* are defined between the four recesses 112*a* to 112*d* on the manifold body 110 and the manifold cover 130. The distribution chamber 102*a* connects to the main channel 104 with the electromagnetic on-off valve 19*a* (refer to FIG. 2). The distribution chamber 102*b* connects to the main channel 104 with the electromagnetic on-off valve 19*b* (refer to FIG. 2). The distribution chamber 102*c* connects to the main channel 104 with the electromagnetic on-off valve 19*c* (refer to FIG. 2). The distribution chamber 102*d* connects to the main channel 104 with the electromagnetic on-off valve 19*d* (refer to FIG. 2). When the electromagnetic on-off valves 19*a* to 19*d* are open, the fuel gas in the main channel 104 flows into the distribution chambers 102*a* to 102*d* through the electromagnetic on-off valves 19*a* to 19*d*. Thick dash-dot arrows indicate fuel gas flows. After flowing into the distribution chambers 102*a* to 102*d*, the fuel gas is fed to the burners 12 through the nozzles 101 in the distribution chambers 102*a* to 102*d*.

As described above with reference to FIG. 1 or 2, the distribution chamber 102*a* feeds the eight burners 12 with the fuel gas. The distribution chamber 102*b* feeds the two burners 12 with the fuel gas. The distribution chamber 102*c* feeds the three burners 12 with the fuel gas. The distribution chamber 102*d* feeds the six burners 12 with the fuel gas. Each burner 12 burns fuel gas at the same maximum flow rate, and the flow rates of fuel gas to be fed to the distribution chambers 102*a* to 102*d* rise as the number of burners 12 to burn the fuel gas increases. Thus, as shown in FIG. 6, a comparison between the distribution chamber 102*a* including the largest number of burners 12 and the distribution chamber 102*b* including the smallest number of burners 12 shows as large as a four-fold difference (=8/2) in the flow rates of fuel gas to be fed to these distribution chambers. The distribution chamber including the largest number of burners 12 (the distribution chamber 102*a* in this embodiment) will be referred to as "the maximum distribution chamber". The distribution chamber 102 including the smallest number of burners 12 (the distribution chamber 102*b* in this embodiment) will be referred to as "the minimum distribution chamber".

As described above with reference to FIG. 4, the main channel 104 connects to the distribution chambers 102*a* to 102*d* through the openings 113*a* to 113*d*, the valve chambers 19*ac* to 19*dc*, and the valve ports 114*a* to 114*d*. Moreover, the valve chambers 19*ac* to 19*dc* accommodate the valve elements 19*av* to 19*dy* and the springs 19*as* to 19*ds* in the electromagnetic on-off valves 19*a* to 19*d*. Thus, increasing the size of the valve ports 114*a* to 114*d* or the electromagnetic on-off valves 19*a* to 19*d* may not prevent a certain channel resistance. With about a four-fold difference in the flow rate of fuel gas to be fed between the maximum distribution chamber (the distribution chamber 102*a* in this embodiment) and the minimum distribution chamber (the distribution chamber 102*b* in this embodiment), the channel resistance that cannot be reduced by the increase of the size may cause shortage of the fuel gas to be fed to the maximum distribution chamber. This can cause inappropriate flow rates of fuel gas to the distribution chambers 102*a* to 102*d*. To distribute fuel gas at appropriate flow rates to the distribution chambers 102*a* to 102*d*, the gas manifold 100 according to the present embodiment has the structure below.

Figure 7:
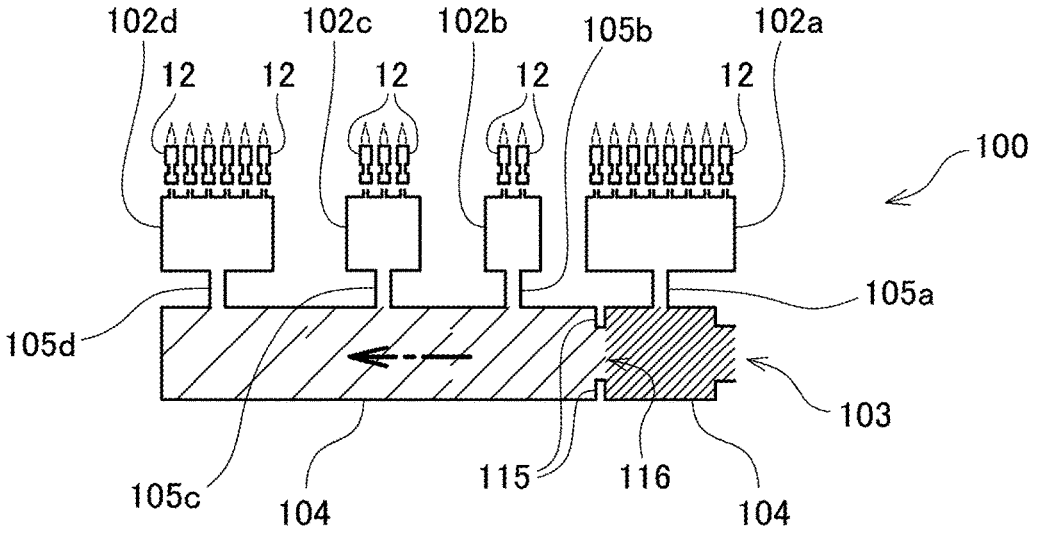
FIG. 7 is a diagram describing a basic mechanism for allowing fuel gas at appropriate flow rates to be distributed to the distribution chambers 102*a* to 102*d* through the gas manifold 100 according to the embodiment.

FIG. 7 is a diagram describing a basic mechanism for allowing fuel gas at appropriate flow rates to be distributed to the distribution chambers 102*a* to 102*d* through the gas manifold 100 according to the present embodiment. As described above, after flowing into the main channel 104 through the inlet 103, the fuel gas flows into the distribution chambers 102*a* to 102*d* from the main channel 104. FIG. 7 shows a distribution channel 105*a* representing the channel from the main channel 104 to the distribution chamber 102*a* described above with reference to FIG. 4 (or the passage from the opening 113*a* through the valve chamber 19*ac* to the valve port 114*a*). Likewise, a distribution channel 105*b* represents the channel from the main channel 104 to the distribution chamber 102*b* (the passage from the opening 113*b* through the valve chamber 19*bc* to the valve port 114*b*). A distribution channel 105*c* represents the channel from the main channel 104 to the distribution chamber 102*c* (the passage from the opening 113*c* through the valve chamber 19*cc* to the valve port 114*c*). A distribution channel 105*d* represents the channel from the main channel 104 to the distribution chamber 102*d* (the passage from the opening 113*d* through the valve chamber 19*dc* to the valve port 114*d*).

The distribution channels 105*a* to 105*d* branch from the main channel 104 at different positions. The branch of the distribution channel 105*a* (hereinafter, the maximum distribution channel) to the maximum distribution chamber (the distribution chamber 102*a* in this embodiment) is nearer an end position than (upstream from) the branches of the distribution channels 105*b* to 105*d* to the three other distribution chambers (the distribution chambers 102*b* to 102*d* in this embodiment). An orifice plate 115 that narrows the main channel 104 is located between the branch of the maximum distribution channel (the distribution channel 105*a* in this embodiment) and the branches of the three other distribution channels 105*b* to 105*d*. The inlet 103, which allows fuel gas to flow into the main channel 104, is adjacent to the branch of the maximum distribution channel (the distribution channel 105*a* in this embodiment).

In this structure, the fuel gas pressure in the main channel 104 is higher in an area upstream from the orifice plate 115 than in an area downstream from the orifice plate 115. In FIG. 7, the main channel 104 from the inlet 103 to the orifice plate 115 is hatched more densely to represent a fuel gas pressure higher than in the remaining part. The distribution channel 105*a* branches from the main channel 104 upstream from the orifice plate 115, allowing the distribution chamber 102*a* to be fed with sufficient fuel gas although the channel resistance may not be reduced in the distribution channel 105*a*.

The orifice plate 115 narrows the main channel 104 into a narrow part 116 having a larger area than the total area of the branches of the distribution channels 105*b* to 105*d* from the main channel 104 other than the maximum distribution channel (the distribution channel 105*a* in this embodiment). The orifice plate 115 thus does not cause the distribution chambers 102*b* to 102*d* to be fed with insufficient fuel gas.

The fuel gas to be fed to the three distribution chambers 102*b* to 102*d* other than the maximum distribution chamber passes through the main channel 104 downstream from the orifice plate 115, and correspondingly the fuel gas pressure decreases in the flow direction of the main channel 104 downstream from the orifice plate 115. Although a higher flow rate causes a larger reduction in the pressure, the flow rate of the fuel gas flowing downstream from the orifice plate 115 may not be too high because this fuel gas is the gas remaining after the distribution chamber 102*a*, or the maximum distribution chamber, is fed with fuel gas. Thus, the pressure in the main channel 104 downstream from the orifice plate 115 may not decrease greatly. In FIG. 7, a thick dash-dot arrow indicates a fuel gas flow in the main channel 104 downstream from the orifice plate 115. The main channel 104 downstream from the orifice plate 115 is hatched more sparsely in the flow direction to indicate a gradually decreasing fuel gas pressure. The main channel 104 downstream from the orifice plate 115 has a slight pressure gradient caused by a fuel gas flow. Thus, the fuel gas pressure is substantially the same at the positions at which the three distribution channels 105*b* to 105*d* branch from the main channel 104. This allows the distribution channels 105*b* to 105*d* to be fed with fuel gas at appropriate flow rates in accordance with the channel resistances of the distribution channels 105*a* to 105*d*.

Additionally, in the gas manifold 100 according to the present embodiment, as shown in FIG. 7, the distribution channel 105*b* (hereinafter, the minimum distribution channel) to the minimum distribution chamber (the distribution chamber 102*b* in this embodiment) branches from a position immediately downstream from the orifice plate 115. This is to feed fuel gas at more appropriate flow rates to the distribution channels 105*b* to 105*d* based on the pressure gradient in the main channel 104 downstream from the orifice plate 115. This will be described below.

As described above, the valve ports 114*a* to 114*d* and the electromagnetic on-off valves 19*a* to 19*d* defining the distribution channels 105*a* to 105*d* are sized depending on the flow rate of fuel gas to be fed through the distribution channels 105*a* to 105*d*. For the distribution channel 105*b* that is the minimum distribution channel, the valve port 114*b* is smaller than the other valve ports 114*a*, 114*c*, and 114*d* and the electromagnetic on-off valve 19*b* is also smaller than the other electromagnetic on-off valves 19*a*, 19*c*, and 19*d*. The valve chamber 19*bc* for the electromagnetic on-off valve 19*b* is also smaller than the valve chambers 19*ac*, 19*cc*, and 19*dc* for the other electromagnetic on-off valves 19*a*, 19*c*, and 19*d*. The small size of the valve chamber 19*bc*, which accommodates the valve element 19*by* and the spring 19*bs* of the electromagnetic on-off valve 19*b*, is likely to cause the minimum distribution channel (the distribution channel 105*b* in this embodiment) to have a channel resistance higher than a design resistance. Thus, the minimum distribution channel (the distribution channel 105*b*) branches from the position immediately downstream from the orifice plate 115, which has the highest pressure in the main channel 104 downstream from the orifice plate 115. This minimum distribution channel allows fuel gas at an appropriate flow rate to be fed with a channel resistance greater than the design resistance.

Figure 8:
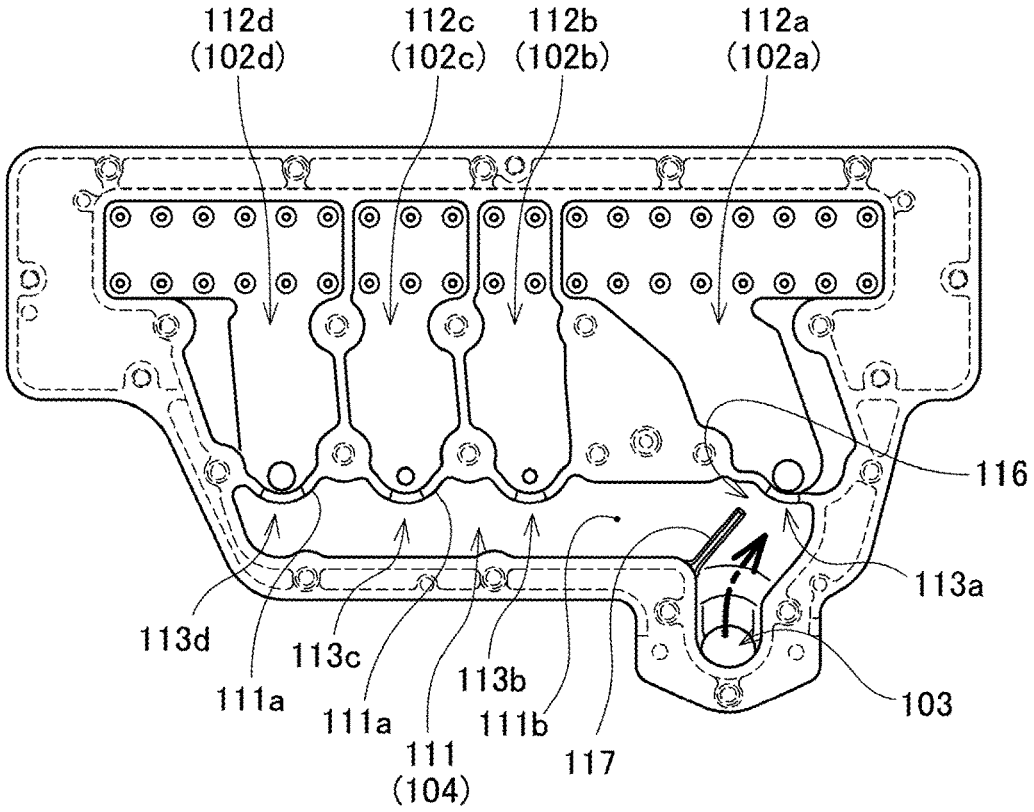
FIG. 8 is a front view of the gas manifold 100 according to the embodiment showing specific shapes of the channel groove 111 and recesses 112*a* to 112*d* on a manifold body 110.

FIG. 8 is a front view of the gas manifold 100 according to the present embodiment showing specific shapes of the channel groove 111 and the recesses 112*a* to 112*d* on the manifold body 110. As described above with reference to FIG. 3, when the sealing member 120 and the manifold cover 130 are fitted to the manifold body 110, the channel groove 111 defines the main channel 104, the recess 112*a* defines the distribution chamber 102*a* (the maximum distribution chamber in the present embodiment), the recess 112*b* defines the distribution chamber 102*b* (the minimum distribution chamber in the present embodiment), the recess 112*c* defines the distribution chamber 102*c*, and the recess 112*d* defines the distribution chamber 102*d*.

As shown in FIG. 8, the recess 112*a* (to define the maximum distribution chamber), out of the four recesses 112*a* to 112*d*, is at the rightmost position in the figure. On the left of the recess 112*a*, the recess 112*b* (to define the minimum distribution chamber) is located, and on its left, the two other recesses 112*c* and 112*d* are located. The channel groove 111 extending in the horizontal direction is below and adjacent to the four recesses 112*a* to 112*d* in the figure. Thus, the channel groove 111 has, in its side wall, the opening 113*a* into the recess 112*a*, the opening 113*b* into the recess 112*b*, the opening 113*c* into the recess 112*c*, and the opening 113*d* into the recess 112*d* in this order from right to left in the figure.

The four recesses 112*a* to 112*d* may be located in the reverse direction (or from left to right in the figure). In this case, the four openings 113*a* to 113*d* are also in the channel groove 111 in the reverse order. The recess 112*a* connecting to the opening 113*a* defines the distribution chamber 102*a*, or the maximum distribution chamber, and thus the opening 113*a* into the recess 112*a* will be referred to as "the largest opening". Similarly, the recess 112*b* connecting to the opening 113*b* defines the distribution chamber 102*b*, or the minimum distribution chamber, and thus the opening 113*b* into the recess 112*b* will be referred to as "the smallest opening".

As shown in FIG. 8, the channel groove 111 on the manifold body 110 according to the present embodiment includes the openings 113*a* to 113*d* aligned horizontally, the inlet 103 between the opening 113*a* (the largest opening) and the opening 113*b* (the smallest opening) for receiving a fuel gas inflow, and a flow guide 117 that guides the fuel gas inflow toward the opening 113*a* (the largest opening). The flow guide 117 protrudes from the bottom 111*b* of the channel groove 111 as a wall. Although the height of the flow guide 117 from the bottom 111*b* is smaller than the depth of the channel groove 111, the upper end of the flow guide 117 comes in contact with the sealing member 120 when the manifold cover 130 is fitted to the manifold body 110 with the sealing member 120 between them. The protruding flow guide 117 narrows the channel groove 111 to define the narrow part 116.

The gas manifold 100 according to the present embodiment includes the flow guide 117, which functions as the orifice plate 115 in FIG. 7. The mechanism described above with reference to FIG. 7 thus allows sufficient fuel gas to be fed to the recess 112*a* defining the maximum distribution chamber. The opening 113*b* (the smallest opening) first branches from the channel groove 111 at a position downstream from the flow guide 117. This allows sufficient fuel gas to be fed to the recess 112*b* defining the minimum distribution chamber. All the recesses 112*a* to 112*d* are thus fed with fuel gas at appropriate flow rates.

As shown in FIG. 8, the inlet 103 for receiving a fuel gas inflow is located between the opening 113*a* (the largest opening) and the opening 113*b* (the smallest opening), and the flow guide 117 guides the fuel gas flow toward the opening 113*a*. As indicated by a thick dash-dot arrow in FIG. 8, the fuel gas flow is guided away from the opening 113*b*, and the fuel gas does not easily flow toward the openings 113*b* to 113*d*. As a result, with the narrow part 116 in the channel groove 111 having an area larger than the total area of the openings 113*b* to 113*d*, the fuel gas does not excessively flow into the openings 113*b* to 113*d*.

Without the flow of fuel gas guided away from the opening 113*b*, the area of the narrow part 116 in the channel groove 111 may be reduced to prevent the fuel gas from excessively flowing into the openings 113*b* to 113*d*. The narrow part 116 with an area smaller than the total area of the openings 113*b* to 113*d* may disable the openings 113*b* to 113*d* from being fed with fuel gas at sufficient flow rates. However, in the gas manifold 100 according to the present embodiment, the narrow part 116 in the channel groove 111 may have an area larger than the total area of the openings 113*b* to 113*d*, thus allowing the recesses 112*b* to 112*d* to be fed with fuel gas at sufficient flow rates. The four recesses 112*a* to 112*d* are thus fed with fuel gas at appropriate flow rates.

Further, the inlet 103 is located in the bottom 111*b* of the channel groove 111. Thus, after flowing in through the inlet 103, fuel gas flows toward the manifold cover 130 (from the depth toward the near side in FIG. 8). After flowing into the main channel 104, the fuel gas (at least the main flow of the fuel gas) flows along the manifold cover 130 (or away from the bottom 111*b* of the channel groove 111). However, as shown in FIG. 4, the openings 113*a* to 113*d* are located in the side wall 111*a* of the channel groove 111 adjacent to the bottom 111*b*. Thus, the fuel gas flowing along the manifold cover 130 does not directly flow into the openings 113*a* to 113*d*. This prevents the fuel gas from flowing intensively into some of the openings 113*a* to 113*d*. The four recesses 112*a* to 112*d* are thus fed with fuel gas at appropriate flow rates.

Further, the openings 113*b* to 113*d* downstream from the flow guide 117 are located in parts of the side wall 111*a* of the channel groove 111 that protrude in an arc toward the middle of the channel groove 111. With one of the openings 113*b* to 113*d* located in a part of the side wall 111*a* of the channel groove 111 that recedes inward, the opening may not easily receive fuel gas. However, in the present embodiment, all the openings 113*b* to 113*d* are located in the arc-shaped parts of the side wall 111*a* of the channel groove 111, with no opening disabled from being fed with fuel gas. This allows any of the recesses 112*a* to 112*d* to be fed with fuel gas at an appropriate flow rate.

The flow guide 117 located in the channel groove 111 has a height from the bottom 111*b* of the channel groove 111 smaller than the depth of the channel groove 111 by the compression allowance of the sealing member 120 (refer to FIG. 3). Thus, when the manifold cover 130 is fitted to the manifold body 110 with the sealing member 120 between them, the upper end of the flow guide 117 comes in contact with the sealing member 120, but applies no reaction force on the sealing member 120 or the manifold cover 130. The structure including the flow guide 117 can avoid a decrease in the contact stress between the sealing member and the main channel 104 and thus avoid leakage of the fuel gas flowing through the main channel 104.

Although the gas manifold 100 according to the present embodiment has been described, the present invention is not limited to the above embodiment, but may be modified variously without departing from the spirit and scope of the present invention.

REFERENCE SIGNS LIST

1 water heater
2 outlet
10 combustion apparatus
11 combustion case
12 burner
12*a* to 12*d* burner set
12*f* burner port
12*o* gas inlet
13 combustion fan
14 spark plug
15 flame rod
16 gas channel
17 main valve
18 proportional valve
19*a* to 19*d* electromagnetic on-off valve
19*ac* to 19*dc* valve chamber
19*as* to 19*ds* spring
19*av* to 19*dv* valve element
20 heat exchanger
21 water supply channel
22 hot-water supply channel
23 flow sensor
24 hot-water supply faucet
100 gas manifold
101 nozzle
101*a* to 101*d* nozzle set
102*a* to 102*d* distribution chamber
103 inlet
104 main channel
105*a* to 105*d* distribution channel
110 manifold body
111 channel groove
111*a* side wall
111*b* bottom
112*a* to 112*d* recess
113*a* to 113*d* opening
114*a* to 114*d* valve port
115 orifice plate
116 narrow part
117 flow guide
120 sealing member
130 manifold cover
140 mounting screw

The invention claimed is:

1. A gas manifold installable in a combustion apparatus to distribute fuel gas to a plurality of burners for burning the fuel gas included in the combustion apparatus, the plurality of burners being grouped into a plurality of burner sets, the combustion apparatus performing stepwise switching of the number of burners to burn the fuel gas by causing each of the plurality of burner sets to burn the fuel gas, the gas manifold comprising:

a main channel configured to allow passage of the fuel gas fed from outside;

a plurality of distribution chambers each located for a corresponding burner set of the plurality of burner sets, the plurality of distribution chambers being configured to receive, from the main channel, the fuel gas to be fed to the plurality of burners in the plurality of burner sets;

a plurality of nozzles each located for a corresponding burner of the plurality of burners, the plurality of nozzles being configured to feed the plurality of burners with the fuel gas flowing into the plurality of distribution chambers;

a plurality of distribution channels branching from the main channel and connecting the main channel to the plurality of distribution chambers; and a plurality of on-off valves each located at a corresponding distribution channel of the plurality of distribution channels to open or close the corresponding distribution channel, wherein the plurality of distribution chambers include a maximum distribution chamber and distribution chambers other than the maximum distribution chamber, and the maximum distribution chamber includes more burners in the corresponding burner set than each of the other distribution chambers, the main channel includes a flow guide configured to guide the fuel gas toward a maximum distribution channel being a distribution channel included in the plurality of distribution channels connected to the maximum distribution chamber, and the flow guide comprises a projection structure that makes a narrow passage in the main channel, a sectional area of the narrow passage being constant and narrower than that of an upstream passage and a downstream passage thereof.

2. The gas manifold according to claim 1, wherein the main channel includes a part narrowed by the flow guide, and the narrowed part has a channel area larger than a total opening area of the distribution channels other than the maximum distribution channel at branches of the other distribution channels from the main channel.

3. The gas manifold according to claim 1, wherein a branch of the maximum distribution channel from the main channel is disposed at an outer side of branches of the other distribution channels from the main channel, and the fuel gas flows into the main channel through an inlet located between the branch of the maximum distribution channel from the main channel and a branch of a distribution channel next to the maximum distribution channel from the main channel.

4. The gas manifold according to claim 3, wherein the plurality of distribution chambers include a minimum distribution chamber and distribution chambers other than the minimum distribution chamber, and the minimum distribution chamber includes fewer burners in the corresponding burner set than each of the other distribution chambers, and the minimum distribution chamber is connected to a minimum distribution channel being a distribution channel included in the plurality of distribution channels, and the minimum distribution channel branches from the main channel at a most upstream position of a plurality of distribution channels branching from the main channel downstream from the flow guide.

5. The gas manifold according to claim 1, wherein the main channel is defined by a manifold cover placed over a channel groove on a manifold body, the plurality of distribution chambers are defined by the manifold cover placed over a plurality of recesses adjacent to the channel groove on the manifold body, the fuel gas flows into the main channel through an inlet that is open from the manifold body to the manifold cover, and the plurality of distribution channels are open in the channel groove nearer a bottom of the channel groove than the manifold cover.

6. The gas manifold according to claim 5, wherein the manifold cover and the manifold body hold a sealing member comprising a compressible material, and the sealing member is located between the manifold cover and the manifold body in a compressed state, the flow guide protrudes from the bottom of the channel groove toward an opening as a wall, and the flow guide protrudes by a height smaller than a depth of the channel groove and is in contact with the sealing member located between the manifold cover and the manifold body.

* * * * *